United States Patent [19]

Nelson

[11] Patent Number: 4,540,181

[45] Date of Patent: Sep. 10, 1985

[54] GAME BALL RETURN BALANCER

[76] Inventor: Donald A. Nelson, 5755 S. Village Way, Ogden, Utah 84403

[21] Appl. No.: 668,084

[22] Filed: Nov. 5, 1984

[51] Int. Cl.[3] ..... A63D 5/02

[52] U.S. Cl. ..... 273/352

[58] Field of Search ..... 273/352, 41, 47, 48, 273/49, 43 R

[56] References Cited

U.S. PATENT DOCUMENTS

| | | | |
|---|---|---|---|
| 2,010,213 | 8/1935 | Bergoffen | 273/352 |
| 2,806,701 | 9/1957 | Durant | 273/352 |
| 2,999,690 | 9/1961 | Huck | 273/43 R |
| 3,215,433 | 11/1965 | Thomsen | 273/49 |
| 3,224,766 | 12/1965 | Vincent | 273/49 |
| 3,458,190 | 7/1969 | Metz | 273/41 |
| 3,572,708 | 3/1971 | Schmid | 273/49 |
| 3,831,939 | 8/1974 | Lorber | 273/48 |

*Primary Examiner*—William H. Grieb

*Attorney, Agent, or Firm*—A. Ray Osburn

[57] ABSTRACT

For a row of bowling type games, a ball return device which assures the return of the proper number of balls to each individual game regardless of where in the row the balls are rolled. A ball collection trough delivers the thrown balls to a ball lift serving a ball return rail with a gate at each individual game. Each gate is controlled by a counting circuit to allow only the correct number of balls to return, through a chute, to each individual game.

5 Claims, 8 Drawing Figures

GAME BALL RETURN BALANCER

BACKGROUND OF THE INVENTION

1. Field

The field of the invention is devices and systems for returning the balls used in bowling type games, more particularly such devices that simultaneously serve several of such individual game devices.

2. State of the Art

Probably all bowling type games now include some automatic means of conveying the thrown or rolled ball back to the vicinity of the player for his subsequent use, without intervention of an attendant. Representative of individual games having such ball return provisions include those disclosed in U.S. Pat. Nos. 2,806,701, 3,458,190, 3,224,766, 3,215,433 and 2,010,213. Considerable sophistication is disclosed in the latter patent, which provides for returning particular balls to selected racks. That is, a person may be provided his own individual ball back to his playing station, although several bowling alleys may be disposed together in parallel relationship, and served by a single ball return device. However, a different problem is presented by the games wherein the balls are not individually designed, nor the games designed for a player to use only a single ball. Of the above, an example of this type of game is disclosed in U.S. Pat. No. 2,010,213, a game device in widespread use and often installed side by side in rows several games long. Players unfortunately often take balls from one game, only to roll them in other games, so that the individual ball return mechanisms at each game do not assure that all games have sufficient balls. To the knowledge of the inventor, no game ball return device for bowling type or other projectile type games has addressed this problem.

BRIEF SUMMARY OF THE INVENTION

With the foregoing in mind, the disadvantages in prior art game ball return devices are eliminated or substantially alleviated in the present invention, which provides for the return of only the correct number of balls for each game in a row thereof. Inclined channel means collect the thrown balls at each game and direct them to a ball lift mechanism at one end of the row, which lift deposits the balls one at a time into an elevated ball rail assembly inclined to return the balls to the games in the row. At each game, a ball gate is provided, cooperating with a ball return chute. A ball return electrical circuit is provided at each game, activated by coins used to start the game, and including solenoid means for holding the ball gate open so that balls in the rail may enter the chute to return to the game. The circuit includes counting means, and provisions for its deactivation automatically upon entry into the chute of the prescribed number of balls for that individual game. On deactivation of the circuit, the solenoid allows the gate to be returned to closed position by spring means. Subsequent balls proceed past that particular game to the next game being used and not having yet received its full complement of return balls. According to another aspect of the invention, the circuitry includes switch means, shutting off the lift when the rail becomes full of balls, to prevent jamming. A lift control circuit is provided, preferably triggered by a switch depressed by each incoming ball and including timing means to limit its operation to the short time required to elevate the ball to the upper rail.

Accordingly, it is a principal object of the invention to provide automatic means for return of only the correct number of balls to each game in a row thereof regardless at which machine the balls are used.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
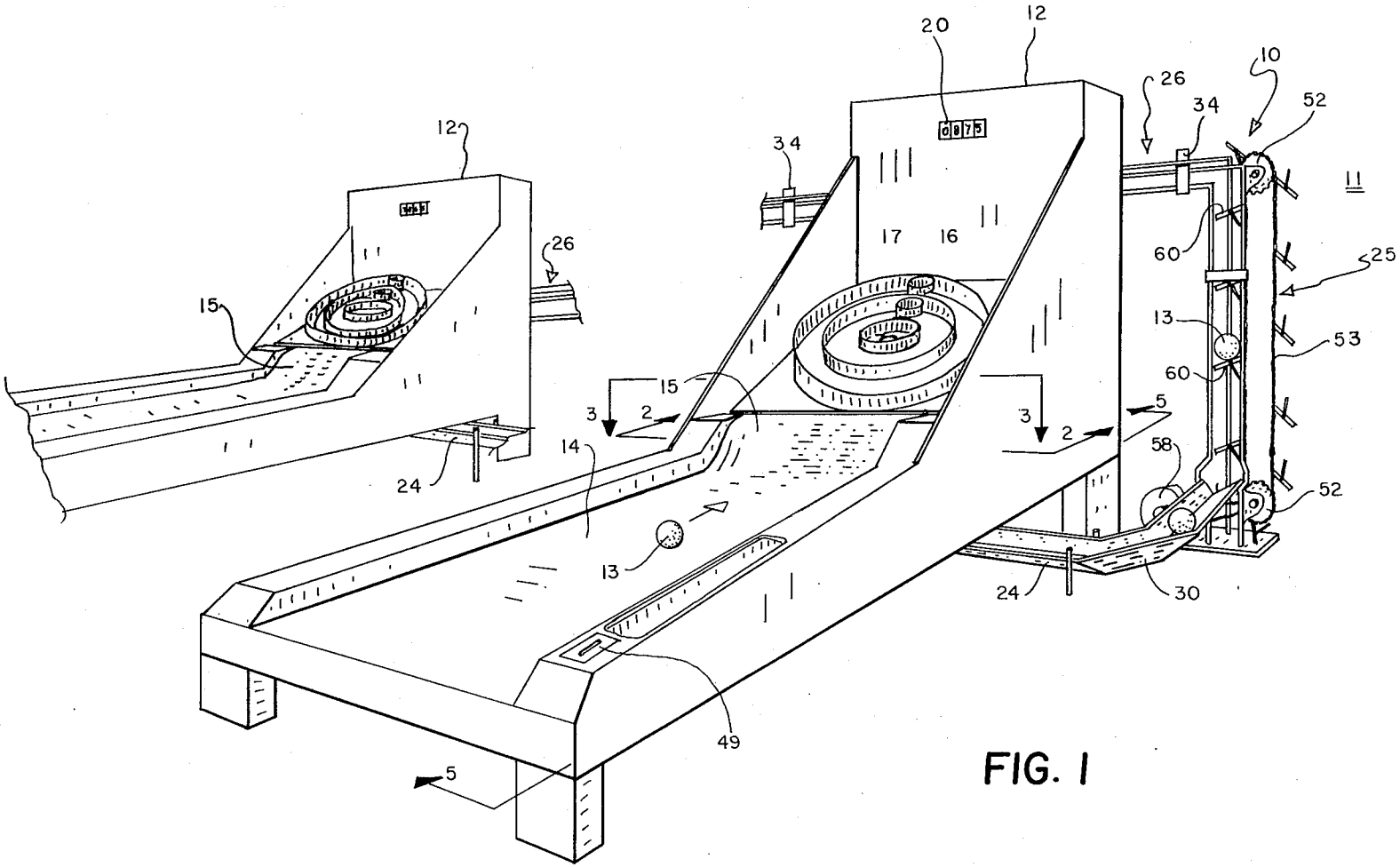
FIG. 1 is a fragmental perspective representation of a game ball return balancer in accordance with the invention, the end game devices of a row thereof being indicated, drawn to a reduced scale, FIG. 2 a vertical cross sectional drawing of the balancer of FIG. 1, taken along line 2—2 thereof, drawn to a somewhat larger scale, FIG. 3 a plan view of a fragment of the balancer of FIG. 1, taken along line 3—3 thereof, drawn to a somewhat increased scale, FIG. 4 a vertical cross sectional view of a ball return board of the balancer fragment of FIG. 3, taken along line 4—4 thereof, drawn to an increased scale, FIG. 5 a vertical cross sectional view of the ball return balancer and associated game device taken along line 5—5 of FIG. 1, drawn to an increased scale, FIG. 6 an elevational view of a fragment of the ball return rail assembly of the balancer showing a typical one of the ball gates thereof, drawn to an increased scale, FIG. 7 a schematic electrical diagram of the ball return balancer electrical system divided by dashed lines into functional blocks, and FIG. 8 a schematic diagram of the electrical system and motor for powering the ball lift of the return balancer.
Figure 3:
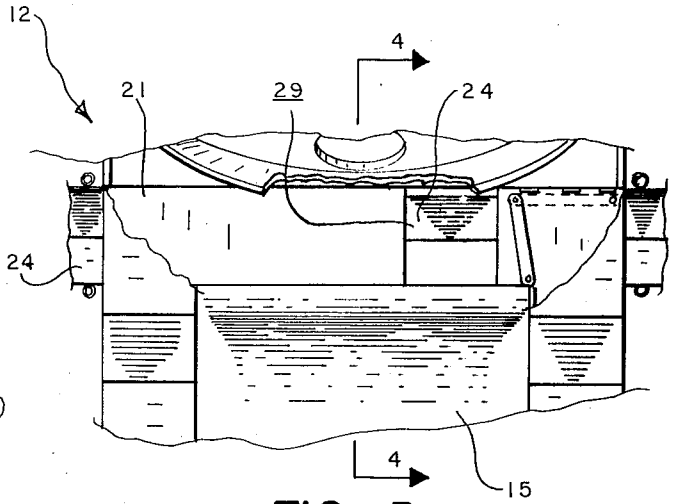
Figure 4:
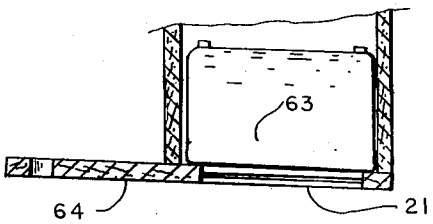
Figure 2:
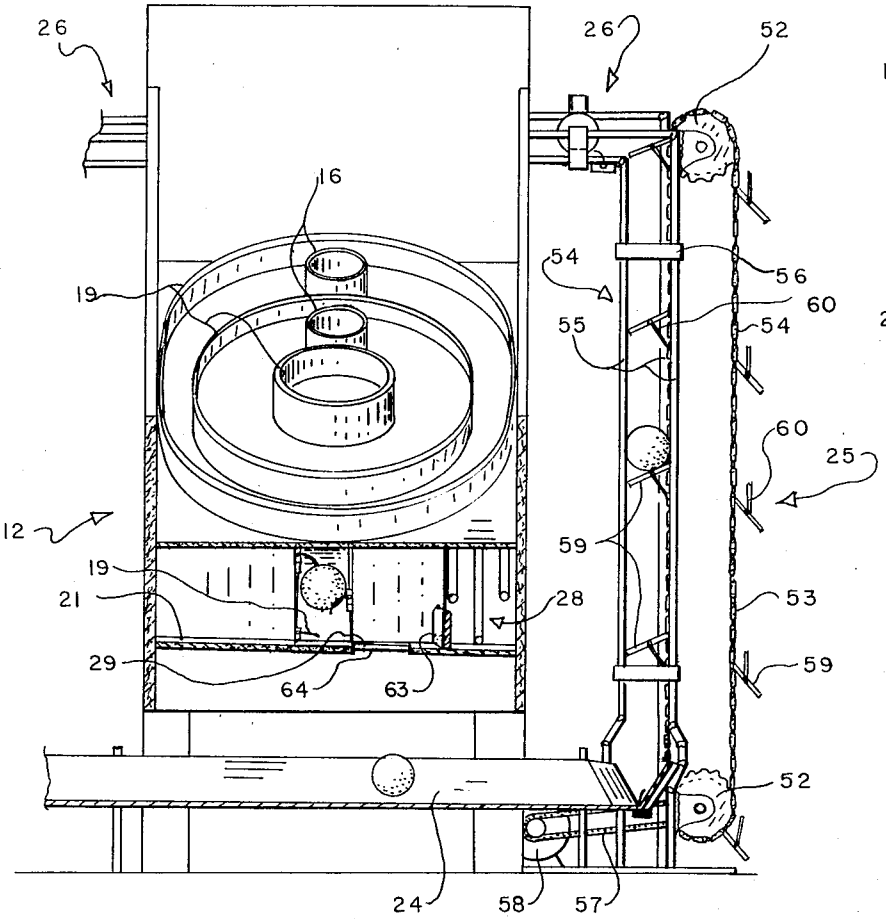

In FIG. 1 a ball return balancer 10 is installed, as upon an adjacent wall 11, to serve a row of several game devices 12, as in an amusement arcade or the like. The individual games 12, modified only slightly for use with balancer 10, are very similar to the game device disclosed in U.S. Pat. No. 2,010,213, and are commonly referred to as the "Skee" ball game.

Figure 5:
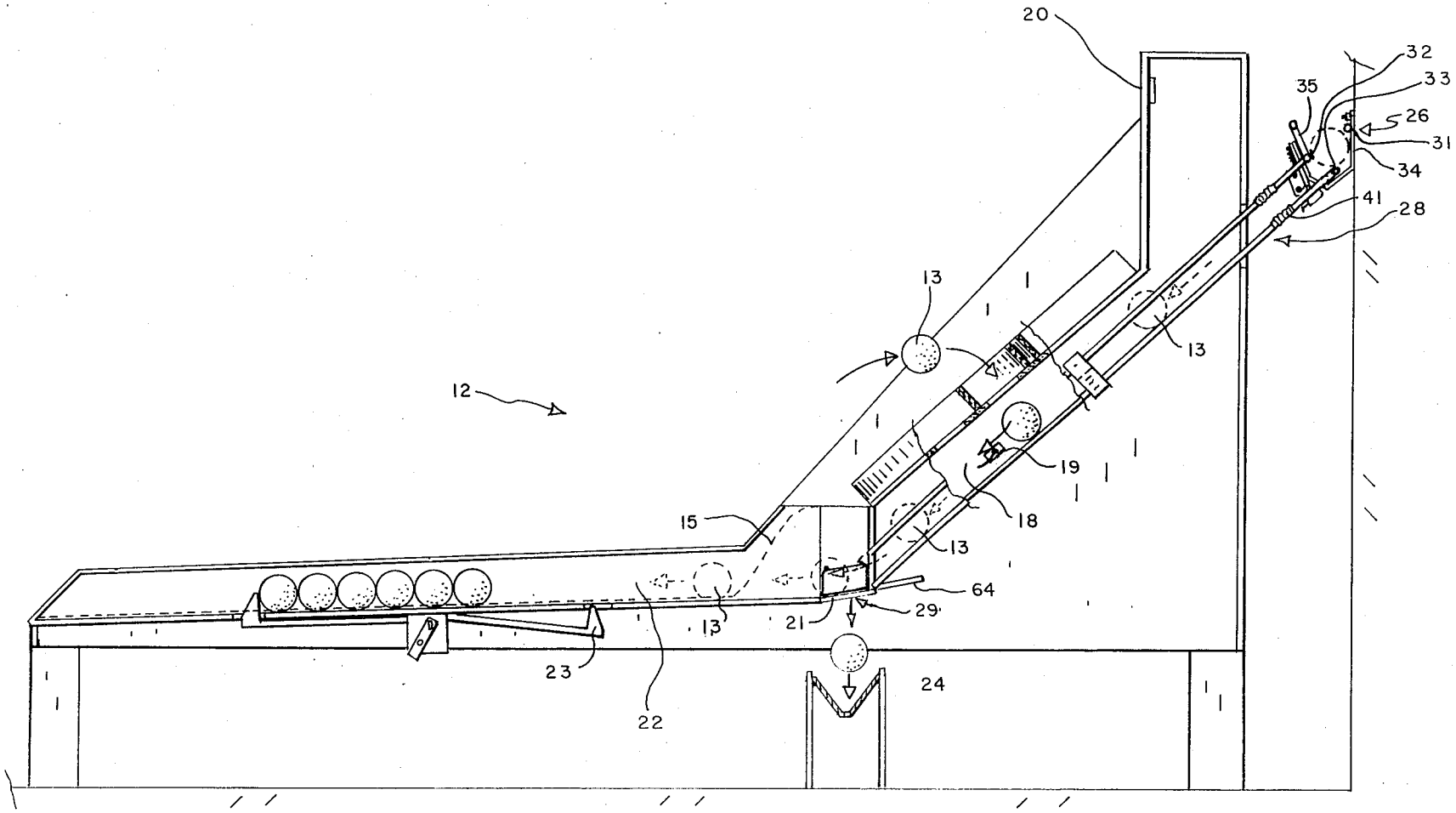
Figure 6:
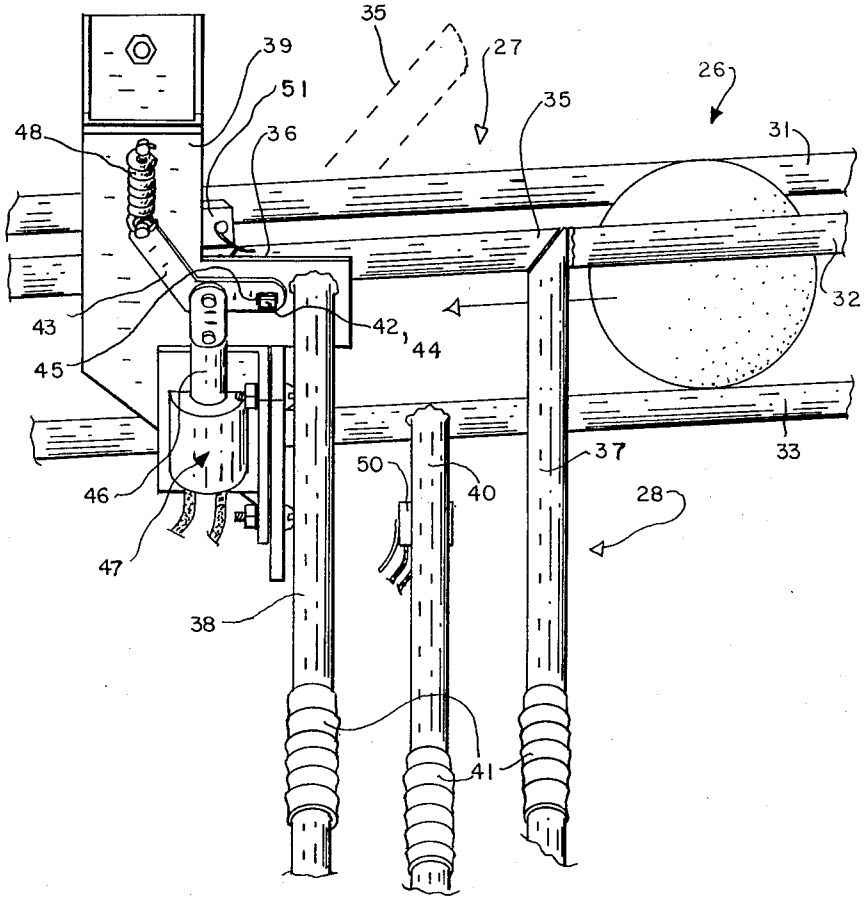

The player propels fist-sized plastic or wooden ball 13 along an approach alley 14, to ascend an up-ramp 15 and become airborne, hopefully into one of the target tubes 16 within inclined concentric annular enclosures 17. Each target tube 16 and each enclosure 17 has a lowermost ball exit opening **16*e* and 17*e* respectively, communicating with a scoring passage 18. Ball 13 triggers scoring switches 19 in passage 18, resulting in a score displayed on a register 20. In games 12 not equipped with return ball balancer 10, ball 13 then rolls down a laterally inclined ball return board 21 onto a return guide channel 22. (FIG. 5) However, ball return board 21 is modified, as described below, to accommodate balancer 10**.

Game device 12 limits the number of balls available to the player for each purchased game, such as by a pivoted gate arm 23. However, players frequently roll balls from one game 12 at another, unbalancing the number of balls among the various games. Return ball balancer 10 assures that each game 12 will be returned the correct number of balls.

Ball return balancer 10 comprises a ball-receiving inclined trough 24 running the length of the row, a ball lift 25 at one end of the row, and a ball return rail 26 elevated along the row, the rail 26 connecting with a ball gate 27 and a ball return chute 28 at each game. Trough 24 runs beneath modified ball return boards 21 of the row of games 12. Each ball, as it emerges from scoring passage 18, falls into trough 24 through a ball drop hole 29 in board 21, and rolls to the end of the row, and around bend 30 onto ball elevator assembly 25. Elevator 25 lifts and deposits ball 13 into rail assembly 26. Ball rail 26 comprises three tubular members 31, 32 and 33, held spaced apart by rail brackets 34, which may also be utilized to support ball rail 26 upon wall 11. Ball 13 rolls upon lower tubes 32 and 33 toward the opposite end of the row. At each game, a separated section 35 of rail tube 32 is pivotally mounted about its end 36 to serve as a ball gate.

At each gate 35, ball return chute 28 is connected to rail assembly 26, chute tube 37 being secured to rail tube 32, and chute tube 38 to a gate bracket 39, on the opposite side of gate 35. A third chute tube 40 is secured to lower tube 33 of rail 26. Gate bracket 39 may, advantageously, serve as a mount for gate actuation components to be described, and also as a rail bracket. From rail 26, chute 28 slopes downwardly and outwardly from wall 11, to direct returning balls 13 upon return board 21, from whence they enter ball return channel 22 of game 11. Advantageously, each tube of chute 28 is constructed with an upper and a lower portion joined by flexible joints 41, to facilitate installation at each game 12.

Gate section 35 of rail tube 32 is connected by a gate pivot pin 42 to gate bracket 39. A crank arm 43 is secured to pivot pin 42, as by engagement of a flattened end 44 thereof by slot-shaped perforation 45. Stem 46 of a solenoid 47, mounted upon gate bracket 39, rotates crank arm 43, turning pin 42 to open gate 27. Spring 48 urges crank arm 43 into gate-closed position when released by deactivation of solenoid 47.

Insertion of a coin into slot 49 at the front of game 11 activates a game-starting switch, to which a ball count circuit is connected. The ball count circuit includes solenoid 47, and maintains it in gate-open position until the desired number of balls 13 are deposited into chute 28, each tripping a ball count-switch 50 at the entrance. On passage of the last desired ball, the count circuit is disconnected by switch 50, solenoid 47 is deactivated, and gate 27 returns to closed position under urging of spring 48. As gate 27 closes it trips a counter reset switch 51, so that the ball count circuit may be activated when the particular game served by the gate is next used. After gate 27 has closed, further balls 13 roll to the next open gate 27 before leaving ball rail 26.

Elevator assembly 25 has a pair of sprockets 52, each engaged by an endless chain 53, and each secured to a lift frame 54 comprising spaced apart tubes 55 held together as by elevator brackets 56. Lower sprocket 52 is powered by "V" belt 57 from a lift motor 58. Ball lift platforms 59 are secured pivotally to chain 53. A propping member 60 engages the chain to hold the platform level when it is traveling upwardly.

A motor control electrical circuit is provided, triggered by a motor switch 61 at the end of trough 24, tripped by each ball as it rolls onto lift 25. The motor control circuit includes a timer, so that lift 25 runs only for a short period sufficient to raise the ball to rail 26. Subsequent balls each trip switch 61 for continued lift operation. Should upper ball rail 26 become full, a lift shutoff switch 62 at the entrance is held permanently depressed, stopping lift 25 to avoid forceable jamming.

Modified ball return board 21 has a ball barrier 63 to assure that none of the returning balls from the chute 28 bounce into drop hole 29 to return to the trough 24, and that balls from scoring passage 18 do not bounce away from hole 29. A sliding drop hole gate 64 may be provided, to be closed in the event it is not desired to use balancer 10. Barrier 63 is then moved to the indicated dashed line position out of the way.

Figure 7:
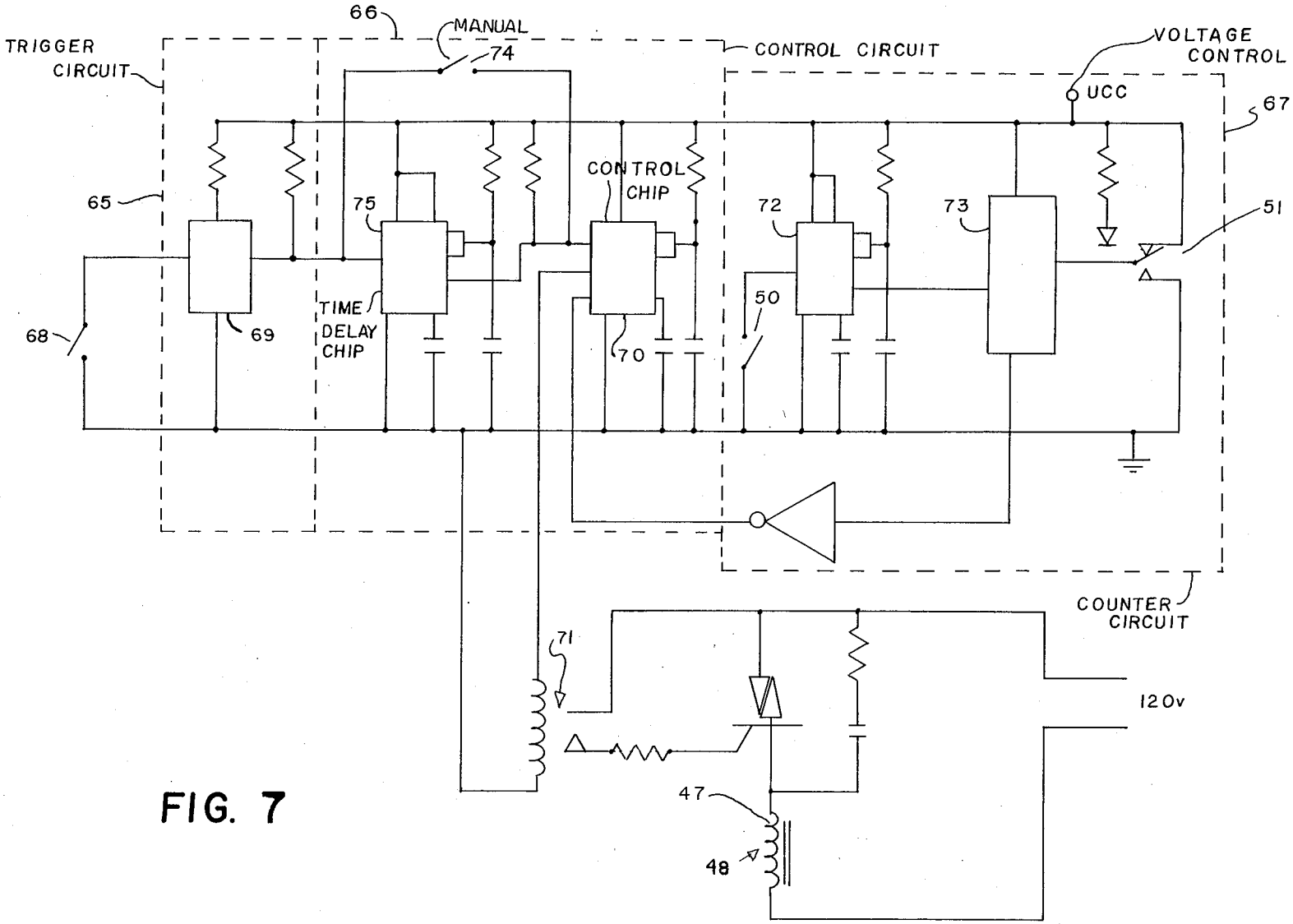

The circuitry for the ball return balancer, may, for example, be as indicated in FIG. 7, including a triggering circuit, a control circuit, and a counting circuit indicated by block areas 65, 66 and 67 respectively. The aforementioned game starting switch, now designated 68, is connected to the trigger circuit 65, which includes chip 69. Control circuit 66 includes a principal control chip 70. Chip 70 along with the indicated associated capacitors and resistances, provides a circuitry to activate the gate solenoid circuit relay switch 71, enabling power from a 120 volt alternating source to be applied to the coil 47 of gate solenoid 48. Chip 70 is also connected through another terminal to protect solenoid 48 from damage, by providing shutting off the current to relay 71 should switch 68 be jammed in closed position. Counter circuit block 67 includes the ball count switch 50, communicating with anti-bounce chip 72, which, along with the associated capacitors and resistances, provides a fractional second delay, so that the count is maintained accurate. Also shown in control box 66 is a manual option switch 74, which when closed provides a circuit bypassing time dalay chip 75. Chip 75, with its associated capacitors and the like, is provided for use only with a type of ball count arrangement found in some of the game devices. Since these devices include electronic ball counting provisions, rather than the tilting rack illustrated herein, delay is needed before return of balls from the rail 26, to avoid overloading the game with excess balls.

Figure 8:
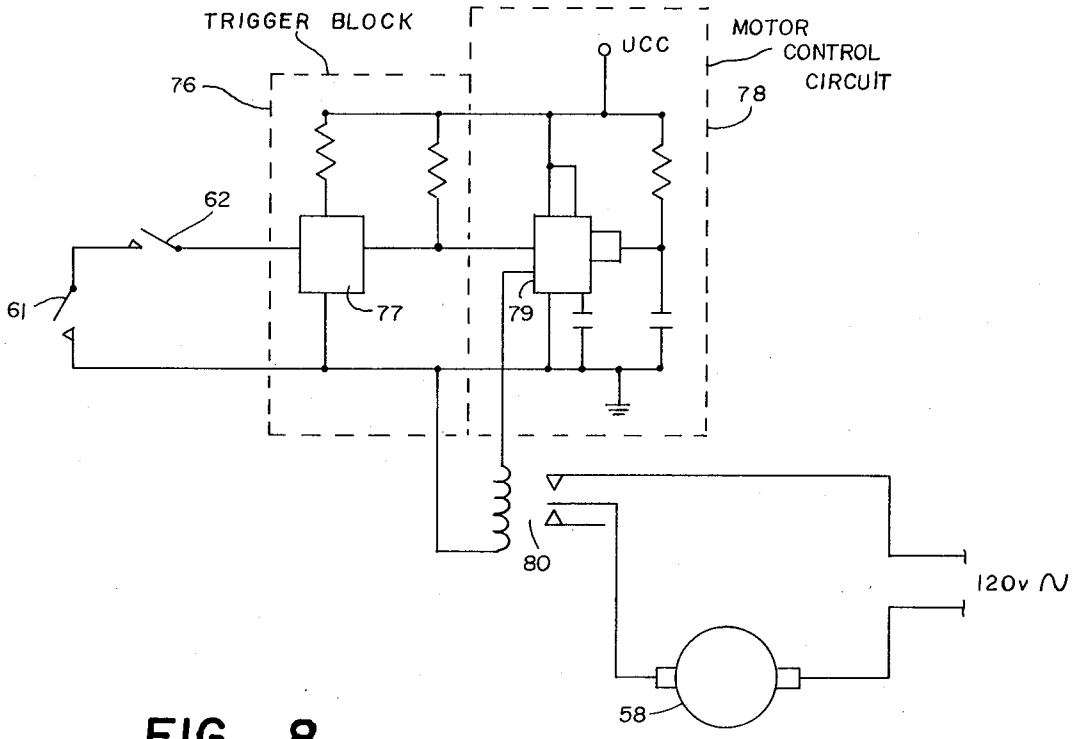

The ball lift motor circuit referred to above may be as illustrated in FIG. 8. Motor start switch 61 is in connection with a motor circuit trigger block 76 consisting principally of control chip 77. Lift shutoff switch 62 is normally closed, held open only when rail 26 is completely full of balls as previously discussed. The motor control circuit block 78 includes control chip 79, which with associated capacitors and resistors provides current to the coil of motor switch relay 80 for a pre-determined period, for instance 5 seconds, as previously discussed.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

I claim:

1. A bowling type game ball return balancer for use with a row of at least two game devices using such balls, said ball return device comprising:

an elongate, longitudinally inclined, upwardly opening trough arranged along the row of game devices;

a game ball return board for installation in each game device, each board having a ball drop opening therethrough, said board being positioned so that each ball thrown by a player rolls by gravity thereon to and inclined so that said ball then rolls to drop through the ball drop opening into the trough;

an elongate ball return rail assembly arranged along the row of game devices, and elevated to be everywhere higher than the ball return boards of the game devices in the row, said rail assembly including a ball gate at each game device in the row, said gate having an open position which allows a ball to roll laterally from the rail assembly, and a closed position preventing the ball from rolling laterally from the rail assembly;

ball conveyor means positioned to lift the game balls from the lowermost end of the trough to the uppermost end of the rail assembly and to deposit said balls onto said rail assembly to roll thereon along the row of game devices toward the opposite end thereof;

a ball return chute connecting with the rail assembly at each ball gate to receive the balls from the rail assembly when the gate is in open position, and arranged to direct the balls downwardly onto the ball return board to return to the game device for subsequent use by a player;

means counting the balls entering the ball return chute;

means closing the open gate in response to the counting means when a pre-set number of balls have entered the chute therethrough;

means for resetting the ball counting means when the gate is closed; and means automatically opening the gate of the game device being used at the beginning of each game.

2. The ball return balancer of claim 1, wherein:

the means opening and closing each ball gate includes an electric solenoid;

the ball counting means includes a switch positioned to be tripped by each ball as it enters the chute;

the means resetting the ball counting means includes a switch positioned to be tripped by the gate as it closes;

the means automatically opening the ball gate includes a switch also serving as the game starting switch; and said ball return balancer further includes at each game device electric circuit means connecting said solenoid, ball counting means, including said ball counting switch, said counter reset switch, and said game starting switch.

3. The ball return balancer of claim 1, wherein the ball conveyor means comprises:

an elongate frame extending from the lowermost end of the trough to the uppermost end of the ball return rail assembly;

a pair of sprocket wheel and axle means, each mounted upon the frame rotatably about the axle, one of said pair being at the lowermost end and the other at the uppermost end of said frame;

endless chain means connecting said sprocket wheel means;

motor and associated power transmission means for rotating one of the sprocket wheels;

a multiplicity of ball-carrying platforms spaced apart equidistantly along the chain means, so that each ball from the trough rolls from the lowermost end thereof onto one of said platforms and is carried thereupon within the frame to the uppermost end of the rail assembly and deposited thereinto to roll by gravity therealong toward the far end of the row of game devices.

4. The ball return balancer of claim 3, wherein the motor means is electrically powered, and the ball conveyor means further comprises:

a conveyor motor start switch positioned within the trough at the lowermost end thereof to be tripped to closed position by each ball as it rolls to the end of the trough; and timing means electrically connected with the motor start switch and limiting to a preset period the time the motor start switch remains in closed position.

5. The ball return balancer of claim 4, further comprising:

a lockout switch within the rail assembly at the ball-entrance end thereof, positioned to be held open by the end ball in the rail assembly should said assembly become completely filled with balls, to prevent the operation of the conveyor until said lockout switch is released.

* * * * *